US006405802B1

(12) United States Patent
Williams

(10) Patent No.: US 6,405,802 B1
(45) Date of Patent: Jun. 18, 2002

(54) SUBSEA FLOWLINE JUMPER HANDLING APPARATUS

(75) Inventor: Michael R. Williams, Houston, TX (US)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/584,557

(22) Filed: May 31, 2000

(51) Int. Cl.[7] ..... E21B 41/04
(52) U.S. Cl. ..... 166/344; 166/341; 166/338
(58) Field of Search ..... 166/338, 339, 166/341–344, 360

(56) References Cited

U.S. PATENT DOCUMENTS

| | | | | |
|---|---|---|---|---|
| 3,302,709 A | | 2/1967 | Postlewaite | |
| 3,448,799 A | | 6/1969 | Ahlstone | |
| 3,603,386 A | | 9/1971 | Talley, Jr. | |
| 3,722,585 A | * | 3/1973 | Nelson et al. | 166/339 |
| 3,953,982 A | | 5/1976 | Pennock | |
| 5,163,783 A | * | 11/1992 | Fahrmeier et al. | 405/195.1 |

* cited by examiner

*Primary Examiner*—David Bagnell
*Assistant Examiner*—Zakiya Walker
(74) *Attorney, Agent, or Firm*—Henry C. Query, Jr.

(57) ABSTRACT

A flowline jumper handling apparatus for supporting a flowline jumper in a generally horizontal position as it is offloaded from a surface structure with a first lifting apparatus and then supporting the flowline jumper in a generally vertical position as it is lowered to a subsea structure with a second lifting apparatus. The flowline jumper handling apparatus comprises an elongated spreader bar, at least one first cable connecting the spreader bar to the flowline jumper, at least one second cable connecting the spreader bar to a through member, at least one third cable connecting the through member to the second lifting apparatus, at least one fourth cable passing through the through member and connecting the flowline jumper to the first lifting apparatus, and a restricting member for preventing a portion of the fourth cable from passing through the through member. In this manner, as the fourth cable is lifted by the first lifting apparatus, the restricting member will engage the through member and support the flowline jumper in a generally horizontal position. Furthermore, as the fourth cable is lowered, the flowline jumper will rotate from the generally horizontal position to the generally vertical position.

14 Claims, 4 Drawing Sheets

SUBSEA FLOWLINE JUMPER HANDLING APPARATUS

BACKGROUND OF THE INVENTION

The present invention relates to an apparatus and method for handling and installing a subsea flowline jumper. More particularly, the invention relates to an apparatus and method for offloading the jumper from a vessel in the horizontal position and then rotating the jumper into the vertical position for installation on two items of subsea equipment.

Flowline jumpers are used in the field of subsea oil and gas production to provide fluid communication between two items of subsea equipment. For example, a flowline jumper may be used to connect the production outlet of a christmas tree to the end of a subsea pipeline that terminates near the christmas tree. Thus, a flowline jumper usually comprises a length of conduit and two fluid couplings, one located at each end of the conduit, which are adapted to mate with corresponding receptacles connected to the subsea equipment. In addition, to facilitate installing the flowline jumper from a surface vessel, the receptacles connected to the subsea equipment are oriented vertically upward and the flowline jumper is constructed so that the conduit and the fluid couplings lie in a single plane with the fluid couplings oriented in the same direction. In this manner, the flowline jumper may be lowered vertically from the surface vessel and the fluid couplings simply landed on the receptacles.

In order to lower the flowline jumper vertically from the vessel, it must first be lifted from the transport vessel into the vertical position. This requires that the flowline jumper either be transported in the vertical position or transported in the horizontal position and then lifted into the vertical position prior to installation. However, flowline jumpers are typically long, bulky and relatively heavy devices. Thus, transporting the flowline jumper in the vertical position usually requires the use of large, expensive vertical shipping frames and fixtures. But, lifting the flowline jumper into the vertical position from the horizontal position increases the risk that the fluid couplings will impact with the boat and be damaged during the critical liftoff operation.

SUMMARY OF THE INVENTION

The present invention overcomes these problems by providing a flowline jumper handling apparatus for lifting a flowline jumper from a surface vessel in a generally horizontal position and then lowering the flowline jumper to a subsea structure in a generally vertical position, the handling apparatus comprising an elongated spreader bar, at least one first cable connecting the spreader bar to the subsea jumper, at least one second cable connecting the spreader bar to a first lifting apparatus located on the surface vessel, at least one through member connected to the spreader bar or to the second cable, at least one third cable passing through the through member and connecting the flowline jumper to a second lifting apparatus located on the surface vessel, and a restricting member connected to the third cable between the flowline jumper and the through member for preventing the third cable from passing through the through member, wherein as the third cable is lifted the restricting member will engage the through member and lift both the spreader bar and the flowline jumper, wherein the length of the third cable between the flowline jumper and the restricting member and the lengths of the first and second cables are selected to maintain the flowline jumper in a generally horizontal position as the third cable is lifted, and wherein the flowline jumper is allowed to rotate from the generally horizontal position to a generally vertical position by releasing the third cable, whereby the subsea jumper may be lifted in the generally horizontal position by the second lifting apparatus and then lowered to the subsea structure in the vertical position by the first lifting apparatus.

The present invention also comprises a method for offloading a flowline jumper from a surface vessel in a generally horizontal position and then lowering the flowline jumper to a subsea structure in a generally vertical position, the method comprising the steps of connecting the flowline jumper to a first lifting apparatus, connecting the flowline jumper to a second lifting apparatus, lifting the flowline jumper from the vessel in the generally horizontal position with the first lifting apparatus, supporting the flowline jumper with the second lifting apparatus, releasing the flowline jumper from the first lifting apparatus to thereby allow the flowline jumper to rotate from the generally horizontal position to the generally vertical position, and lowering the flowline jumper to the subsea structure with the second lifting apparatus.

Thus, the present invention allows the flowline jumper to be transported to the installation site in the horizontal position, eliminating the need for expensive vertical shipping frames and fixtures. In addition, the present invention permits the flowline jumper to be lifted off of the transport vessel in a horizontal position and then rotated to the vertical position, for example after it has been moved away from the transport vessel. This reduces the possibility that the flowline jumper will be damaged as it is being lifted off of the transport vessel.

These and other objects and advantages of the present invention will be made apparent from the following detailed description, with reference to the accompanying drawings. In the drawings, the same reference numbers are used to denote similar components in the various embodiments.

DETAILED DESCRIPTION OF THE PREFERRED EMBODIMENTS

Figure 1:
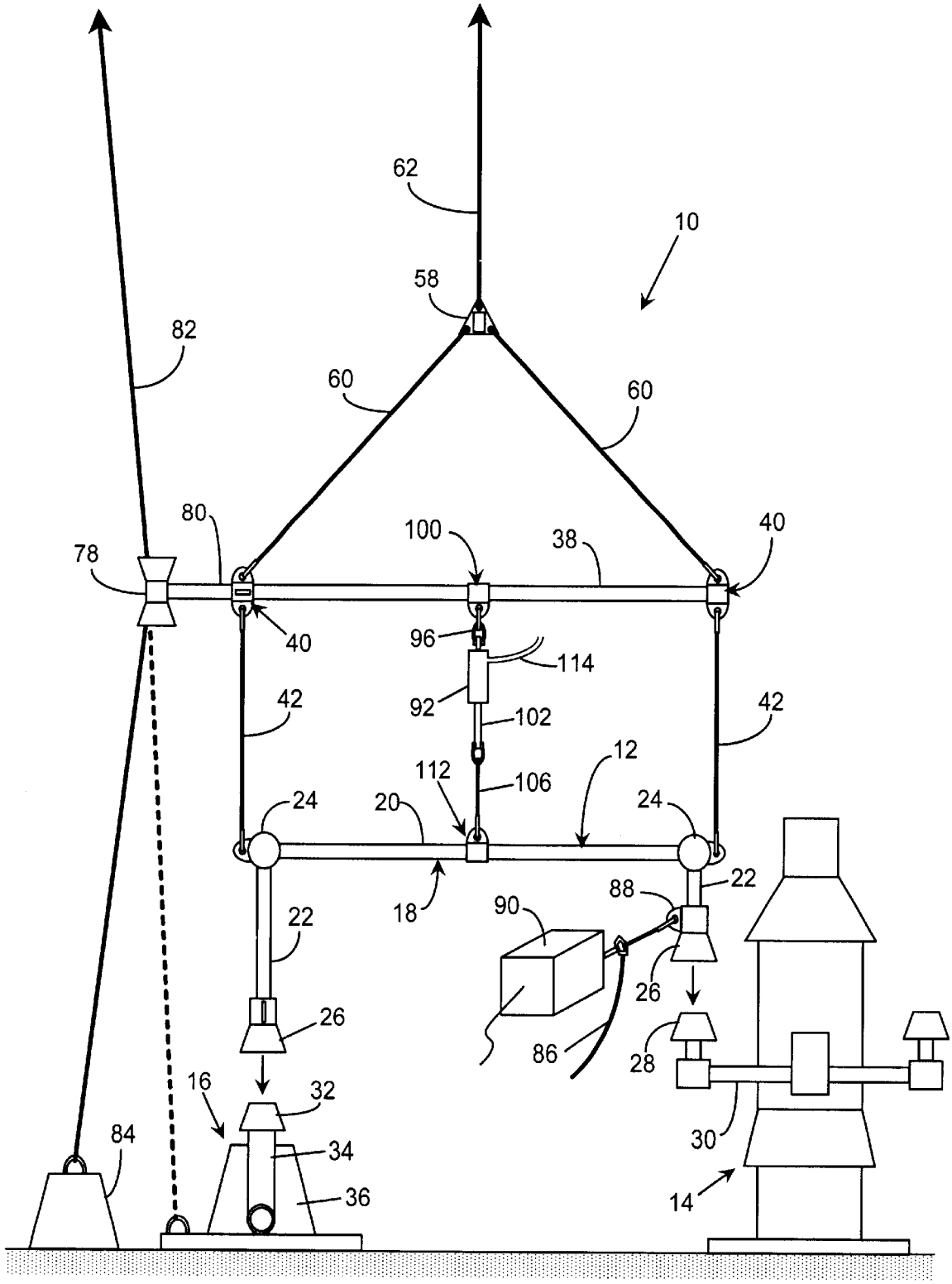
FIG. 1 is a front elevational view of the flowline jumper handling apparatus of the present invention being used to lower a flowline jumper onto a subsea christmas tree and a subsea flowline sled.

Referring to FIG. 1, the flowline jumper handling apparatus of the present invention, which is referred to generally by reference number 10, is shown being used to lower a subsea jumper 12 from a surface structure, such as a vessel or a platform (not shown), to two items of subsea equipment between which a fluid connection is desired to be made, such as the exemplary christmas tree 14 and flowline sled 16 depicted in the drawing. While flowline jumpers in general may take many forms, the flowline jumper 12 illustrated in FIG. 1 is fairly standard in that it comprises a fluid conduit 18, which may include a central span 20 and two transverse end spans 22 connected to the central span through elbows 24, and a fluid coupling 26 connected to each end of the conduit 18. In order to facilitate installing the flowline jumper 12 from a surface structure, the conduit 18 and the couplings 26 are constructed to lie generally in a single plane with the couplings 26 oriented in the same direction. In addition, the corresponding fluid connection receptacles located on the subsea equipment, such as the production outlet receptacle 28 attached to the production outlet 30 of the christmas tree 14 and the flowline receptacle 32 attached to the end of a flowline 34 mounted on a flowline sled 36, are oriented vertically upward. This allows the flowline jumper 12 to be lowered to the subsea equipment in the vertical position so that the fluid couplings 26 may be landed on the receptacles 28, 32. Once the couplings are landed on the receptacles, a secure, fluid-tight connection is made therebetween in a manner known to those skilled in the art.

Figure 2:
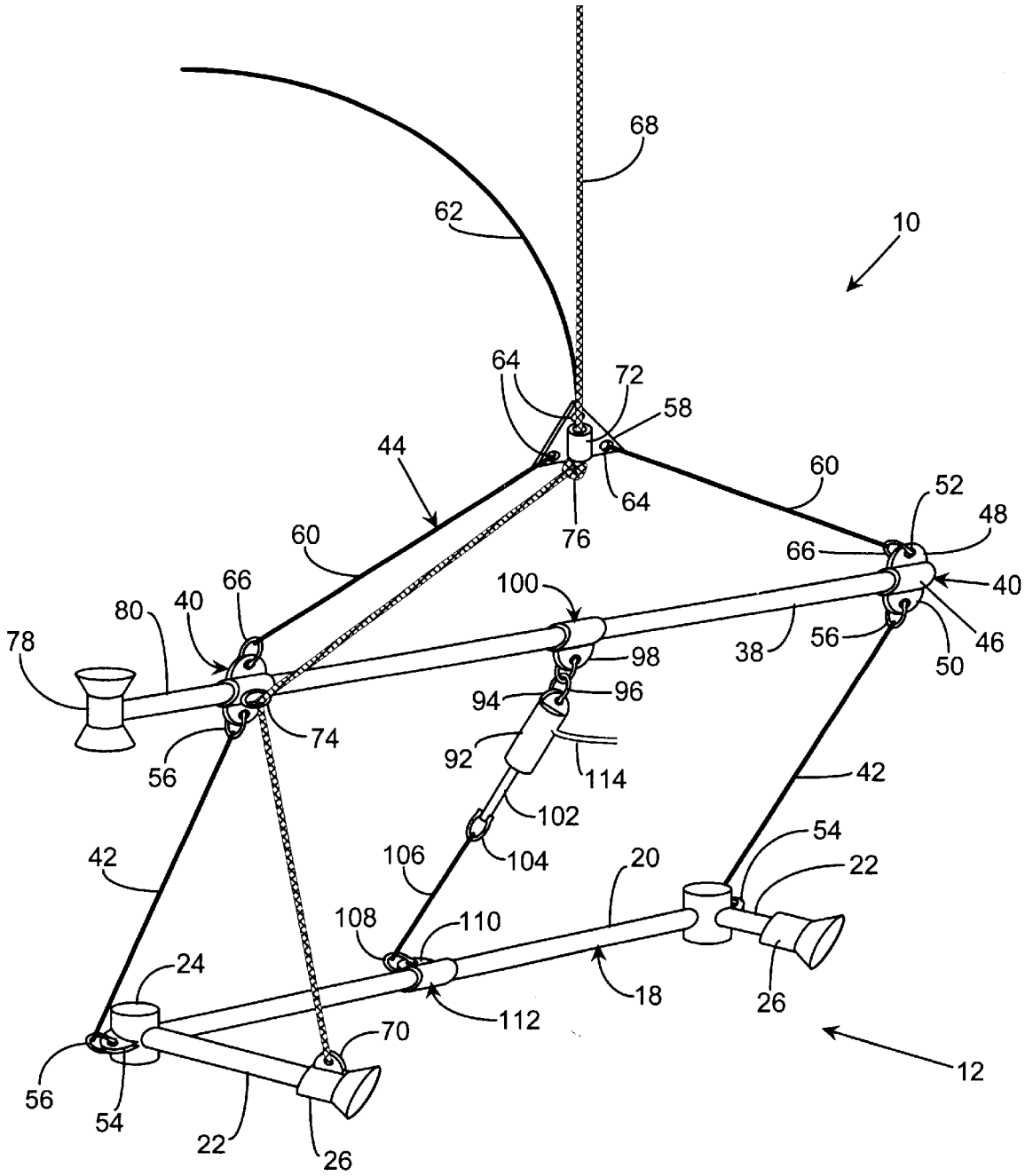
FIG. 2 is a perspective view of the flowline jumper handling apparatus of the present invention.

Referring also to FIG. 2, the flowline jumper handling apparatus 10 is shown to comprise an elongated spreader bar 38, at least one and preferably two hitch assemblies 40 connected at spaced apart locations to the spreader bar 38, a cable 42 connecting each hitch assembly 40 to a respective portion of the flowline jumper 12, and a cable assembly 44 connecting the hitch assemblies 40 to a first lifting apparatus (not shown) located on the surface structure. Each hitch assembly 40 comprises a collar 46, which optimally has a cross section conforming to the cross section of the spreader bar 38, and first and second aperture plates 48, 50, each of which has a hole 52 extending therethrough and is attached to its corresponding collar 46 by, for example, welding. In the preferred embodiment of the invention, the spreader bar 38 is cylindrical, the collars 46 have a circular cross section, and each collar 46 is telescopically received over the spreader bar and secured thereto by appropriate means, such as by fasteners or welding, to connect the hitch assemblies 40 to the spreader bar 38. In addition, while not necessarily a part of the present invention, an aperture plate 54 may be affixed to each portion of the flowline jumper 12 to which a cable 42 is connected, for example, each elbow 24. In this manner, the flowline jumper 12 may be connected to the spreader bar 38 by securing one end of each cable 42 to the aperture plate 50 of a respective hitch assembly 40 and the other end of each cable 42 to the corresponding aperture plate 54 of the flowline jumper 12. To facilitate disconnecting the flowline jumper 12 from the spreader bar 38 after the flowline jumper has been installed, one or each end of each cable 42 may be secured to a clevis 56 or similar means which in turn is secured to the corresponding aperture plate.

While the cable assembly 44 may take many forms, In the preferred embodiment of the invention cable assembly 44 comprises a junction plate 58, a cable 60 connected between each hitch assembly 40 and the junction plate 58, and a cable 62 connecting the junction plate 58 to the first lifting apparatus located on the surface structure. Each cable 60 has one end secured to the aperture plate 48 of its corresponding hitch assembly 40 and the other end secured through a hole 64 in the junction plate 58. In addition, the cable 62 has one end secured through a hole 64 in the junction plate and the other end connected to the first lifting apparatus. To aid in connecting and disconnecting the cables 60 and 62, one or each end thereof may be connected to a clevis 66 or similar means which in turn is connected to a corresponding aperture plate 48 or hole 64.

Thus, it may be observed that the flowline jumper 12 is connected to the flowline handling apparatus 12, which in turn is connected to the first lifting apparatus located on the surface structure. Various alternatives may be envisioned for connecting these components together. For example, the junction plate 58 and cables 60 may be eliminated and the cable 62 connected directly to the spreader bar 38 or to a hitch assembly connected to the spreader bar 38. In addition, the flowline jumper 12 may be connected to the flowline jumper handling apparatus 10 by a single cable 42 connected through the center of gravity of the flowline jumper 12. These variations, and others evident to those skilled in the art, are within the scope of the present invention.

Referring still to FIGS. 1 and 2, the flowline jumper handling apparatus 10 of the present invention also includes a handling cable 68 having one end secured to an aperture plate 70 affixed to the flowline jumper 12 and the other end connected to a second lifting apparatus (not shown) located on a surface structure, which may be either the same surface structure on which the first lifting apparatus is located or a second, separate surface structure. To aid in disconnecting the handling cable 68 from the flowline jumper 12, the end of the handling cable 68 may be connected to a clevis or similar means which in turn is secured to the aperture plate 70. The handling cable 68 passes through a first through member, such as a guide cylinder 72, which is attached to the junction plate 58 by welding or other suitable means. In the preferred embodiment of the invention, the handling cable 68 also passes through a second through member, such as a guide ring 74, which is optimally welded to the hitch assembly 40 that is closest to the aperture plate 70. In addition, suitable means are provided to restrict the handling cable 68 from passing through the guide cylinder 72 as the handling cable 68 is lifted. In the embodiment of the invention depicted in the drawings, the restricting means comprises a dog knot 76 which is formed in the handling cable 68 below the guide cylinder 72. However, any other suitable means may be employed for this purpose, including any bolted-on or molded-on cable stop. Examples of such devices include a split ball, a collar, a rope clip, a sleeve connector or a spelter socket. As the handling cable 68 is lifted vertically upward, the knot 76 will engage the guide cylinder 72, and the handling cable 68 will thus lift the flowline jumper 12 both directly and through the flowline jumper handling apparatus 10. The length of the handling cable 68 between the knot 76 and the aperture plate 70 and the lengths of the cables 42 and 60 are selected to maintain the flowline jumper 12 in a generally horizontal position as the handling cable 68 is lifted. Furthermore, in order to ensure that the flowline jumper 12 remains stable in the horizontal position, the aperture plate 70 is preferably connected to a portion of the flowline jumper which is laterally farthest from the points through which the flowline jumper is connected to the flowline jumper handling apparatus 10, such as the fluid coupling 26 attached to the longer of the end spans 22.

In accordance with one embodiment of the invention, the flowline handling apparatus 10 also comprises a guide funnel 78 connected to the outboard end 80 of the spreader bar 38. A guideline 82 attached to a clump weight 84 located near the subsea equipment is passed through the funnel 78 and secured to the surface structure. Alternatively, the guideline 82 may be attached directly to the subsea equipment, such as the flowline sled 36, as shown in phantom in FIG. 1. As is well understood by those skilled in the art, the guideline 82 and guide funnel 78 are used to guide the flowline jumper handling apparatus 10 in landing the flowline jumper 12 on the subsea equipment, and in particular to guide the fluid coupling 26 onto the flowline receptacle 32. In addition, a separate guideline 86 may be connected to the flowline jumper 12, for example through an aperture plate 88, to allow a remotely operated vehicle ("ROV") 90 to guide the fluid coupling 26 onto the production outlet receptacle 28. Alternatively, the flowline jumper 12 may be maneuvered into place by positioning the surface vessel, with assistance from an ROV pushing or pulling the flowline jumper as needed.

The flowline jumper handling apparatus 10 may also comprise a hydraulic cylinder 92 to aid in orienting the fluid couplings 26 of the flowline jumper 12 with their corresponding receptacles 28, 32 on the subsea equipment as the flowline jumper is being landed and locked to the subsea equipment. An aperture plate 94 is affixed to the end of the cylinder 92 and is connected, preferably via one or more devises 96 or similar means, to the aperture plate 98 of a hitch assembly 100 which is secured to the spreader bar 38 approximately midway between the hitch assemblies 40. The rod 102 of the cylinder 92 is connected, preferably via a clevis 104 or similar means, to a cable 106 which in turn is secured, also preferably via a levis 108 or similar means, to the aperture plate 110 of a hitch assembly 112 which is connected to the central span 20 of the fluid conduit 18 approximately midway between the elbows 24. Thus, the hydraulic cylinder is connected between the spreader bar 38 and the flowline jumper 12.

As the jumper is landed on the subsea equipment, the hydraulic cylinder 92 may be actuated via a hydraulic control line 114 extending to the surface structure to either lift or lower the center span 20 of the conduit 18, which will in turn alter the angle at which the fluid couplings 26 will hang. By retracting the hydraulic cylinder 92, the fluid couplings 26 can be pulled inward. Conversely, by extending the cylinder, the fluid couplings can be allowed to bow outward. Thus, the orientation of the fluid couplings 26 to the receptacles 28, 32 can be better matched, thereby allowing the flowline jumper 12 to land and lock more easily to the subsea equipment.

Figure 3:
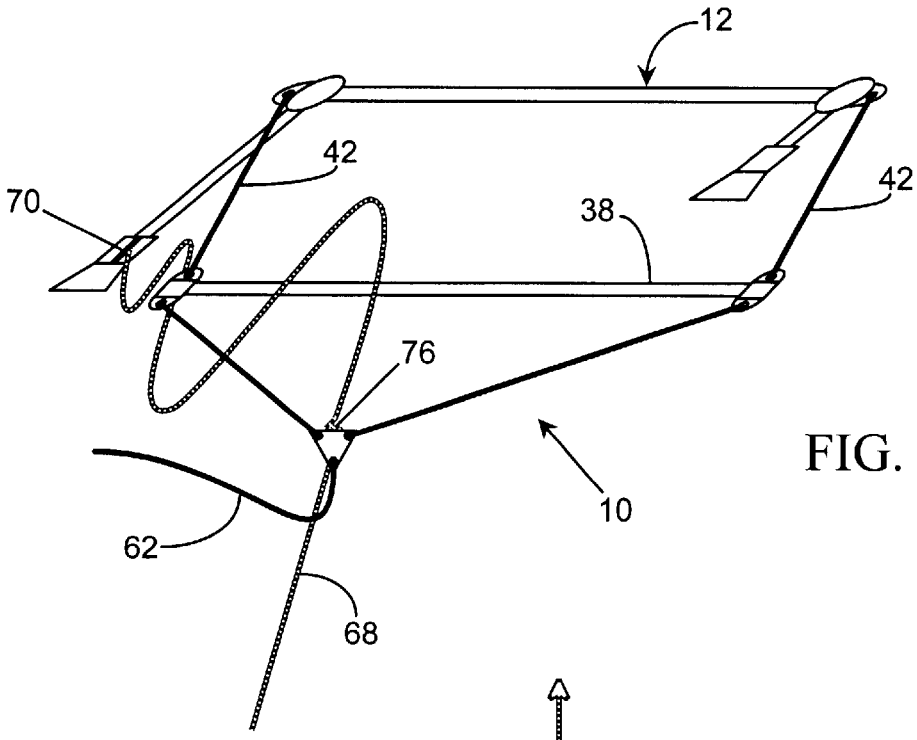
FIGS. 3 through 6 are schematic representations of the flowline jumper handling apparatus, with some of the components omitted for clarity, being used to lift a flowline jumper in a generally horizontal position and then lower the flowline jumper in a generally vertical position.

Referring to FIGS. 3 through 6, the sequence of lifting the flowline jumper off of a surface structure and then lowering the flowline jumper to the subsea equipment will now be discussed. In FIG. 3, the flowline jumper 12 and the flowline jumper handling apparatus 10 are depicted lying in the horizontal position, for example on the deck of a transport vessel (not shown). The flowline jumper 12 is connected to the spreader bar 38 via the cables 42, and the handling cable 68 is threaded through the guide cylinder 72 and the guide ring 74 and connected to the aperture plate 70 affixed to the flowline jumper 12. At this time, the cable 62 may be connected to the first lifting apparatus, such as a winch, and the handling cable 68 may be connected to the second lifting apparatus, for example a rig crane.

Figure 4:
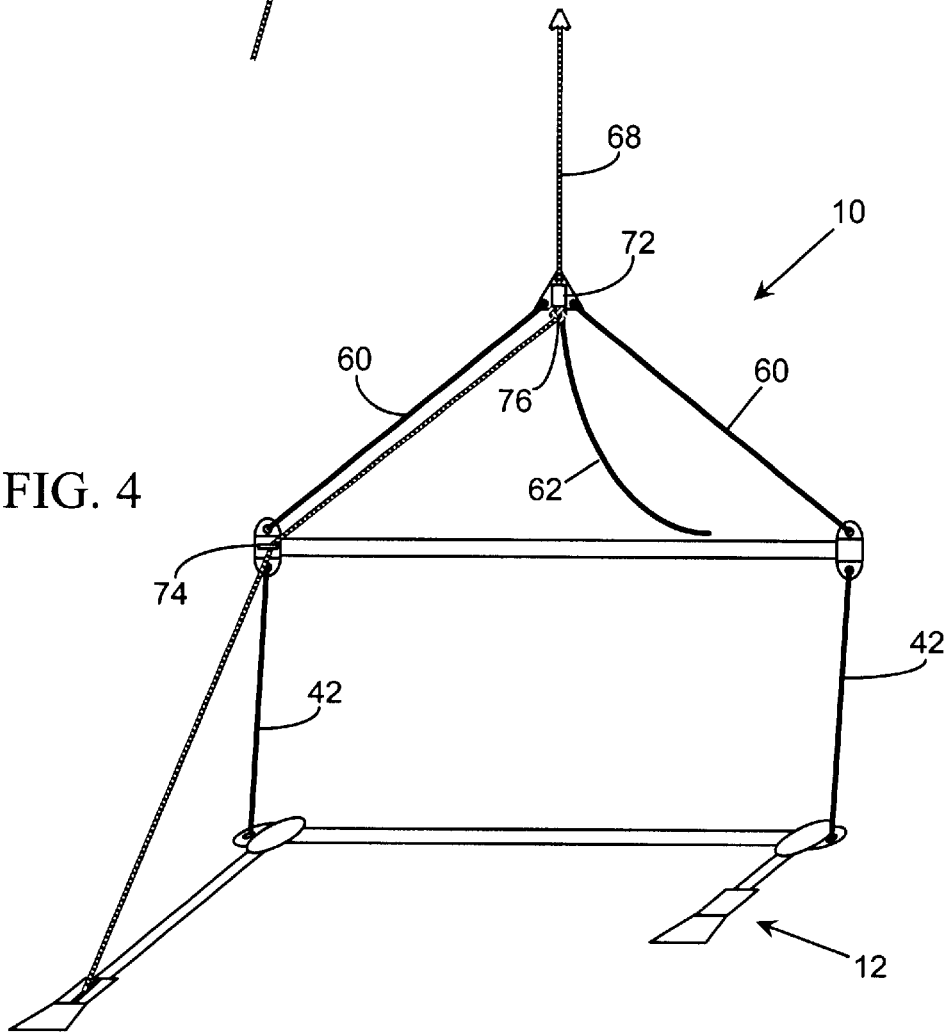

As shown in FIG. 4, the second lifting apparatus is operated to begin lifting the handling cable 68, while the cable 62 is left slack. The second lifting apparatus continues lifting the handling cable 68 as the knot 76 engages the bottom of the guide cylinder 72 and the cables 42, 60 and 68 become taught. Since the length of the handling cable 68 between the knot 76 and the aperture plate 70 and the lengths of the cables 42 and 60 are selected to maintain the flowline jumper 12 in a generally horizontal position as the handling cable 68 is lifted, the cables 42, 60 and 68 should become taught approximately simultaneously with the flowline jumper lying in the horizontal position on the deck. Further lifting of the handling cable 68 will thus bring the flowline jumper 12 off of the deck in a generally horizontal position. At this point the transport vessel may be moved from under the flowline jumper so that the subsea jumper is suspended over the water.

Figure 5:
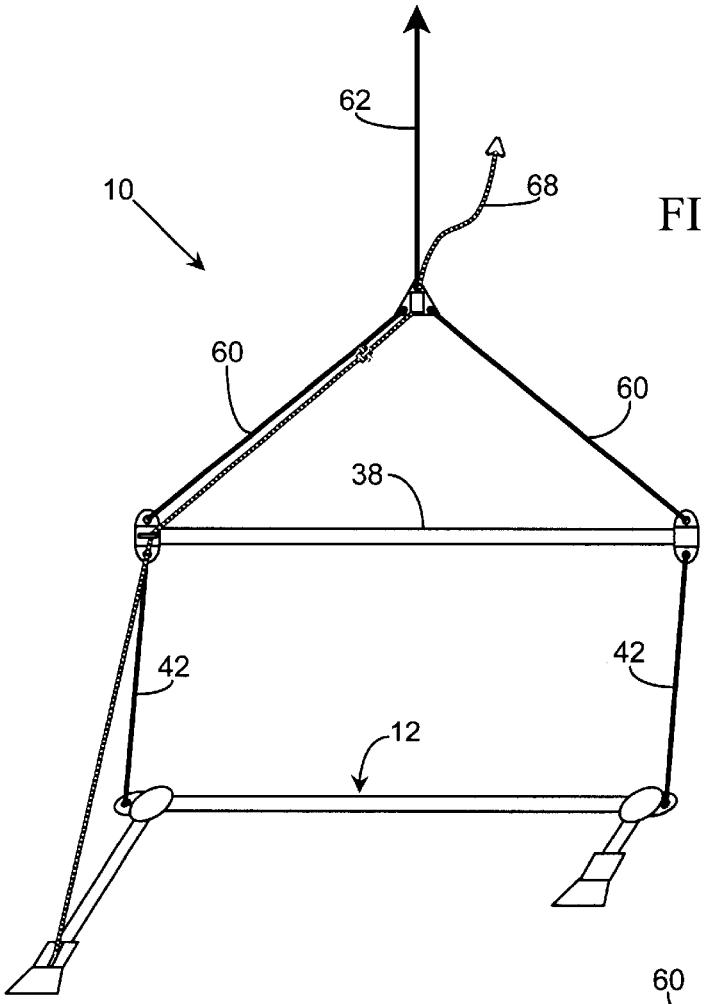
Figure 6:
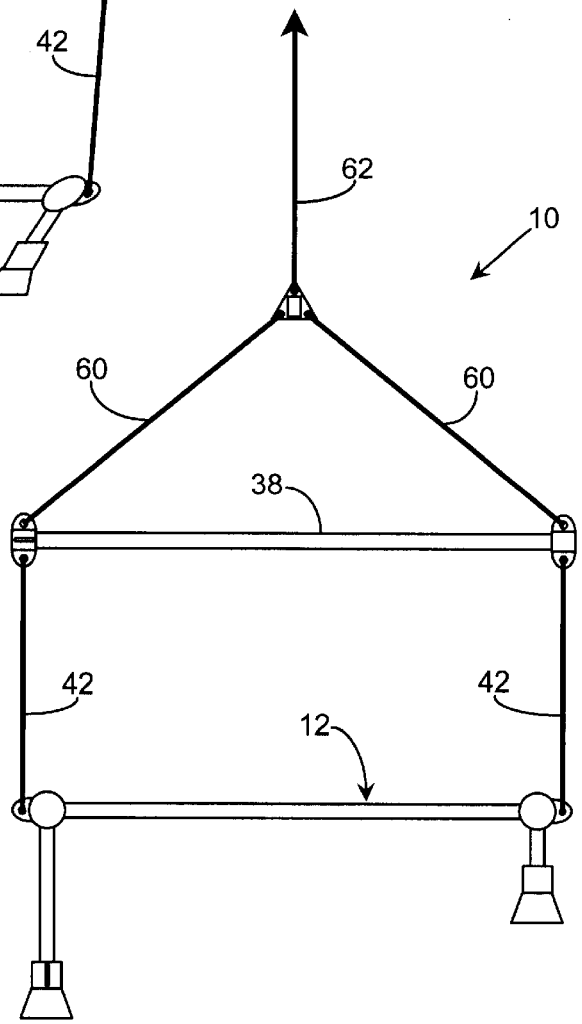

Referring now to FIG. 5, once the flowline jumper 12 is positioned over the water and clear of the surface structures, the handling cable 68 is allowed to slack off so that the cable 62 connected to the first lifting apparatus can now support the flowline jumper 12. As the tension on the handling cable 68 is reduced and the support that the handling cable provides the flowline jumper is eliminated, the flowline jumper 12 will rotate from the generally horizontal position toward the vertical position. Once the flowline jumper reaches the vertical position, as shown in FIG. 6, the handling cable 68 may be disconnected from the flowline jumper and the flowline jumper may be lowered by the cable 62 and the first lifting apparatus to the subsea equipment.

The flowline jumper handling apparatus 10 may also be used to recover the flowline jumper 12 to the surface vessel. This is accomplished by lowering the flowline jumper handling apparatus from the first lifting apparatus on the cable 62 to a position just above the flowline jumper 12. An ROV may then be used to attach the cables 42 to the flowline jumper. The flowline jumper is then lifted to the surface using the cable 62 and the fist lifting apparatus. Once the flowline jumper reaches the surface, one end of the handling cable 68 is attached to the second lifting apparatus and the other end is attached to the flowline jumper through the guide cylinder 72 and the guide ring 74, as previously described and illustrated. The load of the flowline jumper is then transferred from the first lifting apparatus to the second lifting apparatus, thereby causing the flowline jumper to rotate from the vertical position to a horizontal position in a controlled, secure manner. The flowline jumper can then be lifted and lowered back onto the transport vessel in the horizontal position.

Thus, it may be observed that the apparatus and method of the present invention permit the flowline jumper to be transported in the horizontal position, lifted off of the transport vessel still in the horizontal position, controllably rotated into the vertical positioned, and then lowered to the subsea equipment in the vertical position. Thus, the expensive vertical shipping frames and fixtures required to transport a flowline jumper in the vertical position are not needed. In addition, the risk of damage to the flowline jumper by lifting it off of the transport vessel from a horizontal position into the vertical position is eliminated.

Several variations to the invention may be apparent to those of skill in the art. For example, the guide ring 74 may be eliminated and the handling cable 68 passed through only the guide cylinder 72. In yet another embodiment of the invention, the guide ring 74 may be eliminated and the guide cylinder 72 connected to the spreader bar 38 instead of the junction plate 58. In addition, the method of the present invention may be practiced with an apparatus that eliminates the spreader bar 38, the cables 42 and the guide ring 74 and simply connects the cables 60 directly to the aperture plates 54 and the handling cable 68 to the aperture plate 70. These variations, and any others that may be derived from the teachings of the present disclosure by those skilled in the art, are within the scope of the present invention.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

I claim:

1. A flowline jumper handling apparatus for supporting a flowline jumper in a generally horizontal position as it is lifted from a surface structure with a first lifting apparatus and then supporting the flowline jumper in a generally vertical position as it is lowered to a subsea structure with a second lifting apparatus, the flowline jumper handling apparatus comprising:

an elongated spreader bar at feast one first cable connecting the spreader bar to the flowline jumper;

at least one second cable connecting the spreader bar to the second lifting apparatus;

at least one through member connected in a fixed position relative to one or both of the spreader bar and the second cable;

at least one third cable passing through the through member and connecting the flowline jumper to the first lifting apparatus; and restricting means connected to the third cable between the flowline jumper and the through member for preventing a portion of the third cable between the flowline jumper and the restricting means from passing through the through member;

wherein as the third cable is lifted the restricting means will engage the through member and the third cable will support both the spreader bar and the flowline jumper;

wherein the length of the first cable and the length of the third cable between the flowline jumper and the restricting means are selected to maintain the flowline jumper in a generally horizontal position as the third cable is lifted; and wherein the flowline jumper is allowed to rotate from the generally horizontal position to the generally vertical position by lowering the third cable;

whereby the flowline jumper may be lifted in the generally horizontal position by the first lifting apparatus and then lowered to the subsea structure in the vertical position by the second lifting apparatus.

2. The flowline jumper handling apparatus of claim 1, comprising at least two first cables, each having a first end connected to the spreader bar and a second end connected to the flowline jumper.

3. The flowline jumper handling apparatus of claim 2, comprising at least two second cables, each having a first end connected to the spreader bar and a second end connected to a junction plate, and at least one additional second cable having a first end connected to the junction plate and a second end connected to the second lifting apparatus.

4. The flowline jumper handling apparatus of claim 3, wherein the at least one through member is connected to the junction plate.

5. The flowline jumper handling apparatus of claim 4, further comprising a second through member connected to the spreader bar, wherein the third cable passes through the second through member.

6. The flowline jumper handling apparatus of claim 1, wherein the restricting means comprises a cable stop which is bolted on to the third cable.

7. The flowline jumper handling apparatus of claim 1, further comprising means for orienting the flowline jumper with the subsea structure.

8. The flowline jumper handling apparatus of claim 7, wherein the orienting means comprises a hydraulic cylinder connected between the spreader bar and the flowline jumper.

9. A flowline jumper handling apparatus for supporting a flowline jumper in a generally horizontal position as it is lifted from a surface structure with a first lifting apparatus and then supporting the flowline jumper in a generally vertical position as it is lowered to a subsea structure with a second lifting apparatus, the flowline jumper handling apparatus comprising:

an elongated spreader bar;

first and second cables each having first ends connected to respective first and second spaced-apart positions on the spreader bar and second ends connected to respective first and second spaced-apart locations on the flowline jumper;

a cable assembly connecting the spreader bar to the second lifting apparatus, the cable assembly comprising third and fourth cables having first ends connected to a junction plate and second ends connected to the spreader bar proximate the first and second positions, respectively, and a fifth cable having a first end connected to the junction plate and a second end connected to the second lifting apparatus;

a first through member connected to the junction plate;

a handling cable passing through the first through member and having a first end connected to the flowline jumper and a second end connected to the first lifting apparatus; and restricting means connected to the handling cable between the flowline jumper and the first through member for preventing a portion of the handling cable between the flowline jumper and the restricting means from passing through the first through member;

wherein as the handling cable is lifted the restricting means will engage the first through member and the handling cable will support both the spreader bar and the flowline jumper;

wherein the lengths of the first through fourth cables and the length of the handling cable between the flowline jumper and the restricting means are selected to maintain the flowline jumper in a generally horizontal position as the handling cable is lifted; and wherein the flowline jumper is allowed to rotate from the generally horizontal position to the generally vertical position by lowering the handling cable;

whereby the flowline jumper may be lifted in the generally horizontal position by the first lifting apparatus and then lowered to the subsea structure in the vertical position by the second lifting apparatus.

10. The flowline jumper handling apparatus of claim 9, wherein the restricting means comprises a cable stop which is bolted on to the handling cable.

11. The flowline jumper handling apparatus of claim 9, further comprising a second through member connected to the spreader bar, wherein the handling cable passes through the second through member.

12. The flowline jumper handling apparatus of claim 9, further comprising means for orienting the flowline jumper with the subsea structure.

13. The flowline jumper handling apparatus of claim 12, wherein the orienting means comprises a hydraulic cylinder connected between the spreader bar and the flowline jumper.

14. A method for offloading a flowline jumper from a surface vessel in a generally horizontal position with a first lifting apparatus and then lowering the flowline jumper to a subsea structure in a generally vertical position with a second lifting apparatus, the method comprising the steps of:

connecting the flowline jumper to the first lifting apparatus;

connecting the flowline jumper to the second lifting apparatus;

lifting the flowline jumper from the vessel in the generally horizontal position with the first lifting apparatus;

supporting the flowline jumper with the second lifting apparatus;

releasing the flowline jumper from the first lifting apparatus to thereby allow the flowline jumper to rotate from the generally horizontal position to the generally vertical position; and lowering the flowline jumper to the subsea structure with the second lifting apparatus.

* * * * *